US010741983B2

(12) United States Patent
Kitaichi et al.

(10) Patent No.: US 10,741,983 B2
(45) Date of Patent: Aug. 11, 2020

(54) L-SHAPED COAXIAL CONNECTOR AND L-SHAPED COAXIAL CONNECTOR HAVING COAXIAL CABLE

(71) Applicant: Murata Manufacturing Co., Ltd., Kyoto-fu (JP)

(72) Inventors: Yukihiro Kitaichi, Nagaokakyo (JP); Aoi Tanaka, Nagaokakyo (JP); Kenichi Takada, Nagaokakyo (JP); Fumio Mizuki, Nagaokakyo (JP); Kazuo Shima, Nagaokakyo (JP); Daisuke Okada, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/698,906

(22) Filed: Nov. 27, 2019

(65) Prior Publication Data

US 2020/0099180 A1 Mar. 26, 2020

Related U.S. Application Data

(63) Continuation of application No. PCT/JP2018/017337, filed on Apr. 27, 2018.

(30) Foreign Application Priority Data

May 29, 2017 (JP) ..... 2017-105752

(51) Int. Cl.
*H01R 24/42* (2011.01)
*H01R 4/18* (2006.01)
*H01R 9/05* (2006.01)

(52) U.S. Cl.
CPC ..... *H01R 24/42* (2013.01); *H01R 4/185* (2013.01); *H01R 9/0518* (2013.01)

(58) Field of Classification Search
CPC ..... H01R 24/42; H01R 9/0518; H01R 4/185; H01R 9/05; H01R 24/38; H01R 24/50
(Continued)

(56) References Cited

U.S. PATENT DOCUMENTS 4,911,660 A * 3/1990 Alf ..... H01R 9/0518 439/582
6,902,408 B2 * 6/2005 Yamane ..... H01R 24/50 439/581
(Continued)

FOREIGN PATENT DOCUMENTS

CN 204067768 U * 12/2014
JP S50-156791 U 12/1975
(Continued)

OTHER PUBLICATIONS

International Search Report issued in PCT/JP2018/017337; dated Jul. 10, 2018.
(Continued)

*Primary Examiner* — Travis S Chambers
(74) *Attorney, Agent, or Firm* — Studebaker & Brackett PC

(57) ABSTRACT

An L-shaped coaxial connector having a coaxial cable includes a coaxial cable including a central conductor portion and an external conductor portion disposed around the central conductor portion and a center conductor portion, an internal terminal connected to the central conductor portion, an external terminal connected to the external conductor portion, and an insulating member disposed between the internal and external terminals. The external terminal includes a cylindrical portion surrounding the first terminal portion and extending in a cylindrical shape in a direction intersecting an axial direction of the coaxial cable. The internal terminal includes a male type first terminal portion having a cylindrical shape and extending in the direction
(Continued)

intersecting the axial direction, and a second terminal portion extending to connect from the first terminal portion to the central conductor portion. The insulating member includes a protruding portion protruding configured to insert into the first terminal portion.

16 Claims, 12 Drawing Sheets

(58) Field of Classification Search
USPC ..... 439/578, 579–585, 63, 65
See application file for complete search history.

(56) References Cited

U.S. PATENT DOCUMENTS

| | | | | |
|---|---|---|---|---|
| 9,444,167 | B2 * | 9/2016 | Fukushima | H01R 13/04 |
| 2015/0364843 | A1 * | 12/2015 | Yamauchi | H01R 9/053 439/394 |

FOREIGN PATENT DOCUMENTS

| | | | |
|---|---|---|---|
| JP | H03-033981 | U | 4/1991 |
| JP | H11-307158 | A | 11/1999 |
| JP | 2000-340303 | A | 12/2000 |
| JP | 4193133 | B2 | 12/2008 |
| JP | 2013-097914 | A | 5/2013 |
| JP | 2015-115111 | A | 6/2015 |
| JP | 2016-004662 | A | 1/2016 |
| JP | 2017-004703 | A | 1/2017 |
| JP | 2017-091969 | A | 5/2017 |
| WO | 2016/163140 | A1 | 10/2016 |

OTHER PUBLICATIONS

International Preliminary Report on Patentability and Written Opinion issued in PCT/JP2018/017337; dated Dec. 3, 2019.

* cited by examiner

L-SHAPED COAXIAL CONNECTOR AND L-SHAPED COAXIAL CONNECTOR HAVING COAXIAL CABLE

CROSS-REFERENCE TO RELATED APPLICATIONS

This application claims benefit of priority to International Patent Application No. PCT/JP2018/017337, filed Apr. 27, 2018, and to Japanese Patent Application No. 2017-105752, filed May 29, 2017, the entire contents of each are incorporated herein by reference.

BACKGROUND

Technical Field

The present disclosure relates to an L-shaped coaxial connector and an L-shaped coaxial connector having a coaxial cable.

Background Art

In an existing technique, an L-shaped coaxial connector to which a coaxial cable is connected and an L-shaped coaxial connector having a coaxial cable have been known as described, for example, in International Publication No. 2016/163140.

The L-shaped coaxial connector in International Publication No. 2016/163140 includes an internal terminal to be connected to a central conductor portion of a coaxial cable, an external terminal (housing) to be connected to an external conductor portion of the coaxial cable, and an insulating member (bushing) to be disposed between the internal terminal and the external terminal. When the coaxial connector is connected to a mating connector, the internal terminal and the external terminal of the coaxial connector are fitted to respective corresponding terminals of the mating connector.

The internal terminal of the coaxial connector of International Publication No. 2016/163140 has a female type (socket type) shape which is configured to receive a male type (pin type) terminal of the mating connector.

SUMMARY

In recent years, it has been desired to reduce a dimension of a coaxial connector in a height direction, that is, to reduce a height of the coaxial connector. In order to reduce the height of the coaxial connector, it is necessary to lower heights of an internal terminal and an external terminal.

Since the coaxial connector of International Publication No. 2016/163140, as described above, includes the internal terminal of the female type, it is necessary to provide the internal terminal with predetermined spring characteristics in order to ensure engagement with the male type terminal. When the height of the coaxial connector of International Publication No. 2016/163140 is reduced, in order to maintain the spring characteristics while reducing the height of the internal terminal, the height of the internal terminal in a lateral direction perpendicular to a height direction (a radial direction in a case of a cylindrical shape) needs to be increased. However, when the internal terminal becomes larger in the lateral direction, electrical capacitance coupling is apt to occur between the internal terminal and the external terminal disposed in a vicinity of the internal terminal, and electric characteristics of the coaxial connector may deteriorate.

Therefore, the present disclosure provides an L-shaped coaxial connector and an L-shaped coaxial connector having a coaxial cable capable of reducing a height of the coaxial connector by making an internal terminal smaller while suppressing deterioration in electric characteristics.

An L-shaped coaxial connector having a coaxial cable according to the present disclosure includes a coaxial cable including a central conductor portion and an external conductor portion disposed around the central conductor portion, an internal terminal connected to the central conductor portion of the coaxial cable, an external terminal connected to the external conductor portion of the coaxial cable, and an insulating member disposed between the internal terminal and the external terminal. The external terminal includes a cylindrical portion extending in a cylindrical shape in a direction intersecting an axial direction of the coaxial cable. The internal terminal includes a first terminal portion that is a male type, that has a cylindrical shape, and that extends in the direction intersecting the axial direction of the coaxial cable, and a second terminal portion extending so as to be connected from the first terminal portion to the central conductor portion of the coaxial cable. The first terminal portion is inserted with the insulating member and surrounded by the cylindrical portion, and the insulating member includes a protruding portion protruding so as to be inserted into the first terminal portion.

Moreover, an L-shaped coaxial connector according to the present disclosure is an L-shaped coaxial connector to which a coaxial cable including a central conductor portion and an external conductor portion disposed around the central conductor portion is to be connected, and includes an internal terminal to be connected to the central conductor portion of the coaxial cable, an external terminal to be connected to the external conductor portion of the coaxial cable, and an insulating member disposed between the internal terminal and the external terminal. The external terminal includes a cylindrical portion extending in a cylindrical shape in a direction intersecting an axial direction of the coaxial cable. The internal terminal includes a first terminal portion that is a male type, that has a cylindrical shape, and that extends in the direction intersecting the axial direction of the coaxial cable, and a second terminal portion extending so as to be connected from the first terminal portion to the central conductor portion of the coaxial cable. The first terminal portion is inserted with the insulating member and surrounded by the cylindrical portion, and the insulating member includes a protruding portion protruding so as to be inserted into the first terminal portion.

According to the L-shaped coaxial connector and the L-shaped coaxial connector having the coaxial cable according to the present disclosure, it is possible to reduce a height of the internal terminal while suppressing deterioration in electric characteristics.

DETAILED DESCRIPTION

Figure 1:
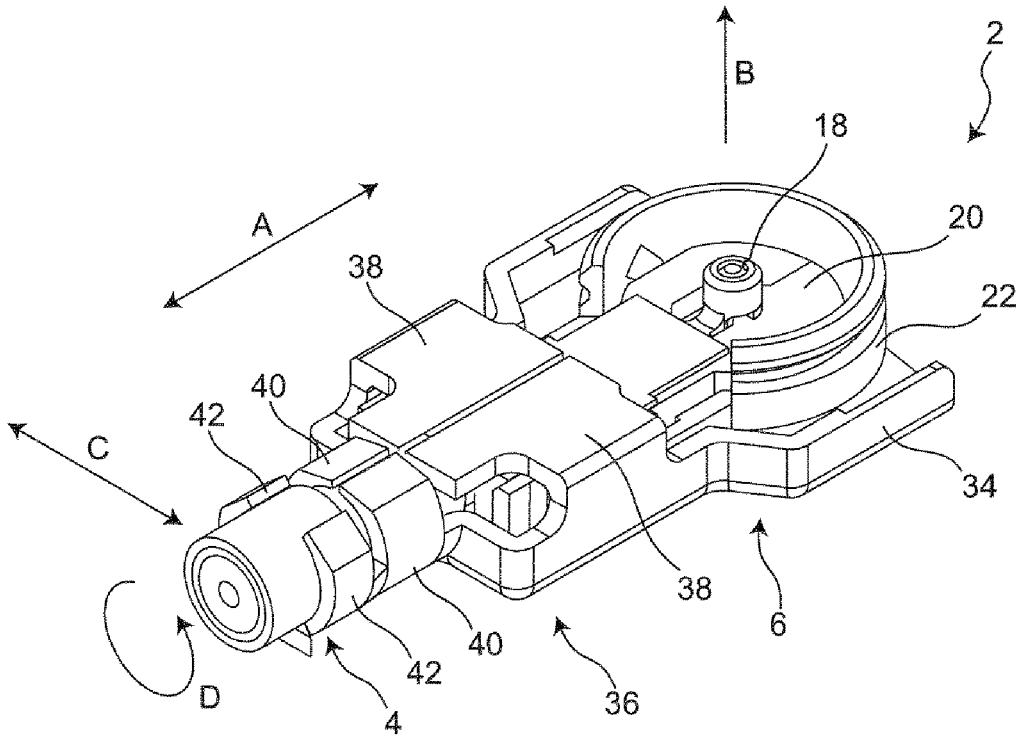
FIG. 1 is a perspective view of a plug cable according to a first embodiment.

According to a first aspect of the present disclosure, an L-shaped coaxial connector having a coaxial cable is provided that includes a coaxial cable including a central conductor portion and an external conductor portion disposed around the central conductor portion, an internal terminal connected to the central conductor portion of the coaxial cable, an external terminal connected to the external conductor portion of the coaxial cable, and an insulating member disposed between the internal terminal and the external terminal. The external terminal includes a cylindrical portion extending in a cylindrical shape in a direction intersecting an axial direction of the coaxial cable. The internal terminal includes a first terminal portion that is a male type, that has a cylindrical shape, and that extends in the direction intersecting the axial direction of the coaxial cable, and a second terminal portion extending so as to be connected from the first terminal portion to the central conductor portion of the coaxial cable. The first terminal portion is inserted with the insulating member and surrounded by the cylindrical portion, and the insulating member includes a protruding portion protruding so as to be inserted into the first terminal portion.

According to this configuration, the internal terminal is made to be a male type, so that the internal terminal can be made smaller than an internal terminal made to be a female type. Even when the internal terminal is made smaller, the protruding portion of the insulating member is inserted into the first terminal portion of the internal terminal, so that strength of the internal terminal is reinforced. Therefore, since an overall shape of the internal terminal can be reduced, electrical capacitance coupling with the external terminal can be suppressed, thereby reducing a height of the coaxial connector while suppressing deterioration in electric characteristics of the coaxial connector.

According to a second aspect of the present disclosure, the L-shaped coaxial connector having the coaxial cable according to the first aspect is provided in which the cylindrical portion of the external terminal is cylindrical, the first terminal portion is cylindrical, and when a side into which the insulating member is inserted is defined as a base end portion, and an end portion on a side opposite to the base end portion is defined as a tip end portion, a convex portion forming a curved surface is provided at the tip end portion. According to this configuration, since a shape of the first terminal portion of the internal terminal is a cylindrical shape having a rounded tip end, capacitance coupling between the internal terminal and the external terminal can be suppressed, and electric characteristics can be improved.

According to a third aspect of the present disclosure, the L-shaped coaxial connector having the coaxial cable according to the first aspect or the second aspect is provided in which the first terminal portion includes a through-hole extending from the base end portion to the tip end portion. According to this configuration, since a length of the protruding portion of the insulating member to be inserted into the first terminal portion can be lengthened, strength of the internal terminal can be further reinforced.

According to a fourth aspect of the present disclosure, the L-shaped coaxial connector having the coaxial cable according to the third aspect is provided in which the protruding portion of the insulating member is housed in the first terminal portion. According to this configuration, since the protruding portion of the insulating member does not protrude from the tip end of the first terminal portion, interference among the protruding portion and other members can be prevented.

According to a fifth aspect of the present disclosure, the L-shaped coaxial connector having the coaxial cable according to the fourth aspect is provided in which the protruding portion of the insulating member extends to a same position as the tip end portion in an axial direction of the first terminal portion. According to this configuration, since the protruding portion of the insulating member is disposed in an inner portion of the first terminal portion over an entire length in the axial direction, the strength of the internal terminal can be reinforced to a maximum possible extent.

According to a sixth aspect of the present disclosure, the L-shaped coaxial connector having the coaxial cable according to any one of the first to fifth aspects is provided in which the second terminal portion of the internal terminal is formed in a flat plate shape, and has a forked portion that is bifurcated at a tip end thereof, and the forked portion is disposed so as to sandwich the central conductor portion. According to this configuration, it is possible to secure a larger contact area between the second terminal portion of the internal terminal and the central conductor portion of the coaxial cable, and thus it is possible to obtain favorable electric characteristics.

According to a seventh aspect of the present disclosure, the L-shaped coaxial connector having the coaxial cable according to the sixth aspect is provided in which a first extension portion and a second extension portion in the forked portion have a same and constant width and a same and constant thickness with each other. According to this configuration, capacitance coupling between the internal terminal and the external terminal can be suppressed, and favorable electric characteristics can be obtained.

According to an eighth aspect of the present disclosure, the L-shaped coaxial connector having the coaxial cable according to the sixth or seventh aspect is provided in which the central conductor portion has an inclined portion inclined in a direction intersecting the axial direction of the coaxial cable, and the forked portion is disposed so as to sandwich the inclined portion. According to this configuration, the central conductor portion can be firmly sandwiched by the forked portion by providing the inclined portion in the central conductor portion.

According to a ninth aspect of the present disclosure, the L-shaped coaxial connector having the coaxial cable according to any one of the first to eighth aspects is provided in which the insulating member further includes an outer frame portion disposed inside the cylindrical portion of the external terminal and surrounding the protruding portion, and a recess is formed between the outer frame portion and the protruding portion. According to this configuration, a thickness of the outer frame portion can be changed by changing a position of an inner peripheral surface of the outer frame portion while forming the recess between the outer frame portion and the protruding portion without changing a position of an outer peripheral surface of the outer frame portion. Thus, impedance adjustment of the L-shaped coaxial connector can be easily performed.

According to a tenth aspect of the present disclosure, an L-shaped coaxial connector is provided to which a coaxial cable including a central conductor portion and an external conductor portion disposed around the central conductor portion is to be connected, and the L-shaped coaxial connector includes an internal terminal to be connected to the central conductor portion of the coaxial cable, an external terminal to be connected to the external conductor portion of the coaxial cable, and an insulating member disposed between the internal terminal and the external terminal. The external terminal includes a cylindrical portion extending in a cylindrical shape in a direction intersecting an axial direction of the coaxial cable. The internal terminal includes a first terminal portion that is a male type, that has a cylindrical shape, and that extends in the direction intersecting the axial direction of the coaxial cable, and a second terminal portion extending so as to be connected from the first terminal portion to the central conductor portion of the coaxial cable. The first terminal portion is inserted with the insulating member and surrounded by the cylindrical portion, and the insulating member includes a protruding portion protruding so as to be inserted into the first terminal portion.

According to this configuration, the internal terminal is made to be a male type, so that the internal terminal can be made smaller than an internal terminal made to be a female type. Even when the internal terminal is made smaller, the protruding portion of the insulating member is inserted into the first terminal portion of the internal terminal, so that strength of the internal terminal is reinforced. Therefore, since an overall shape of the internal terminal can be reduced, electrical capacitance coupling with the external terminal can be suppressed, thereby reducing a height of the coaxial connector while suppressing deterioration in electric characteristics of the coaxial connector.

According to an eleventh aspect of the present disclosure, the L-shaped coaxial connector according to the tenth aspect is provided in which the cylindrical portion of the external terminal is cylindrical, the first terminal portion is cylindrical, and when a side into which the insulating member is inserted is defined as a base end portion, and an end portion on a side opposite to the base end portion is defined as a tip end portion, a convex portion forming a curved surface is provided at the tip end portion. According to this configuration, since a shape of the first terminal portion of the internal terminal is a cylindrical shape having a rounded tip end, capacitance coupling between the internal terminal and the external terminal can be suppressed, and electric characteristics can be improved.

According to a twelfth aspect of the present disclosure, the L-shaped coaxial connector according to the tenth aspect or the eleventh aspect is provided in which the first terminal portion includes a through-hole extending from the base end portion to the tip end portion. According to this configuration, since a length of the protruding portion of the insulating member to be inserted into the first terminal portion can be lengthened, strength of the internal terminal can be further reinforced.

According to a thirteenth aspect of the present disclosure, the L-shaped coaxial connector according to the twelfth aspect is provided in which the protruding portion of the insulating member is housed in the first terminal portion. According to this configuration, since the protruding portion of the insulating member does not protrude from the tip end of the first terminal portion, interference among the protruding portion and the other members can be prevented.

According to a fourteenth aspect of the present disclosure, the L-shaped coaxial connector according to the thirteenth aspect is provided in which the protruding portion of the insulating member extends to a same position as the tip end portion in an axial direction of the first terminal portion. According to this configuration, since the protruding portion of the insulating member is disposed in an inner portion of the first terminal portion over an entire length in the axial direction, the strength of the internal terminal can be reinforced to a maximum possible extent.

According to a fifteenth aspect of the present disclosure, the L-shaped coaxial connector according to any one of the tenth to fourteenth aspects is provided in which the second terminal portion of the internal terminal is formed in a flat plate shape, and has a forked portion that is bifurcated at a tip end thereof, and the forked portion is disposed so as to sandwich the central conductor portion. According to this configuration, it is possible to secure a larger contact area between the second terminal portion of the internal terminal and the central conductor portion of the coaxial cable, and thus it is possible to obtain favorable electric characteristics.

According to a sixteenth aspect of the present disclosure, the L-shaped coaxial connector according to the fifteenth aspect is provided in which a first extension portion and a second extension portion in the forked portion have a same and constant width, and a same and constant thickness with each other. According to this configuration, capacitance coupling between the internal terminal and the external terminal can be suppressed, and favorable electric characteristics can be obtained.

According to a seventeenth aspect of the present disclosure, the L-shaped coaxial connector according to the fifteenth aspect or the sixteenth aspect is provided in which the insulating member further includes an outer frame portion disposed inside the cylindrical portion of the external terminal and surrounding the protruding portion, and a recess is formed between the outer frame portion and the protruding portion. According to this configuration, a thickness of the outer frame portion can be changed by changing a position of an inner peripheral surface of the outer frame portion while forming the recess between the outer frame portion and the protruding portion without changing a position of an outer peripheral surface of the outer frame portion. Thus, impedance adjustment of the L-shaped coaxial connector can be easily performed.

Hereinafter, the first embodiment according to the present disclosure will be described in detail with reference to the accompanying drawings.

First Embodiment

FIG. 1 is a perspective view illustrating an L-shaped coaxial connector (hereinafter, referred to as a plug cable) 2 having a coaxial cable according to the first embodiment.

The plug cable 2 illustrated in FIG. 1 includes a coaxial cable 4 and an L-shaped coaxial connector (first connector) 6 to which the coaxial cable 4 is connected. When the plug cable 2 is used, the L-shaped coaxial connector 6 is fitted to a mating connector (second connector) 8 illustrated in FIG. 2.

Figure 2:
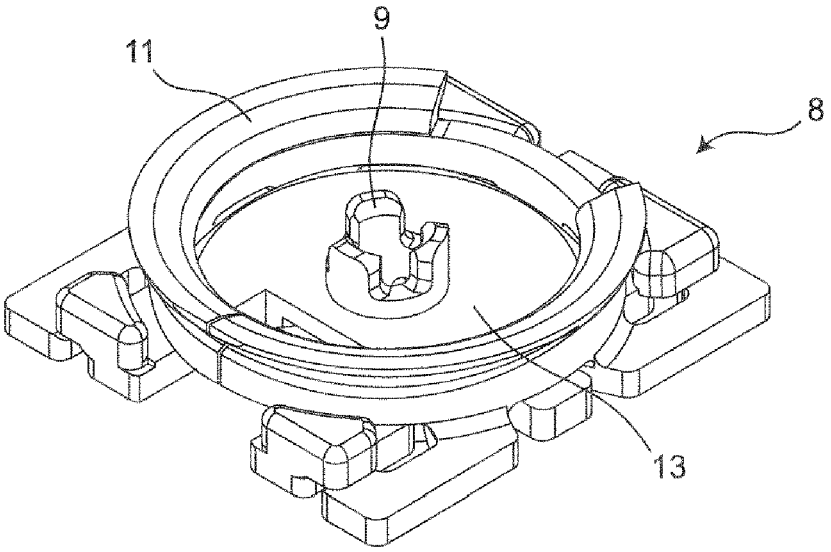
FIG. 2 is a perspective view of a mating connector to be connected to the plug cable according to the first embodiment.

In the first embodiment, the mating connector 8 illustrated in FIG. 2 includes an internal terminal (center socket) 9, an external terminal 11, and an insulating member (resin mold case) 13 disposed between the internal terminal 9 and the external terminal 11.

While the L-shaped coaxial connector 6 illustrated in FIG. 1 is connected to the coaxial cable 4, a substrate (not illustrated) is mounted on a rear surface of the external terminal 11 in the mating connector 8 illustrated in FIG. 2. That is, combination of the plug cable 2 and the mating connector 8 according to the first embodiment is a connection mode in which "a coaxial cable" and "a substrate" are connected to each other, unlike a so-called "board to board" in which a substrate and a substrate are connected to each other.

The internal terminal 9 illustrated in FIG. 2 has a female shape for receiving a male-shaped terminal. Thus, the mating connector 8 becomes a plug receptacle for the plug cable 2 illustrated in FIG. 1. The male shape has a contact surface on an outer peripheral portion, and the female shape has a contact surface on an inner peripheral portion.

Figure 3:
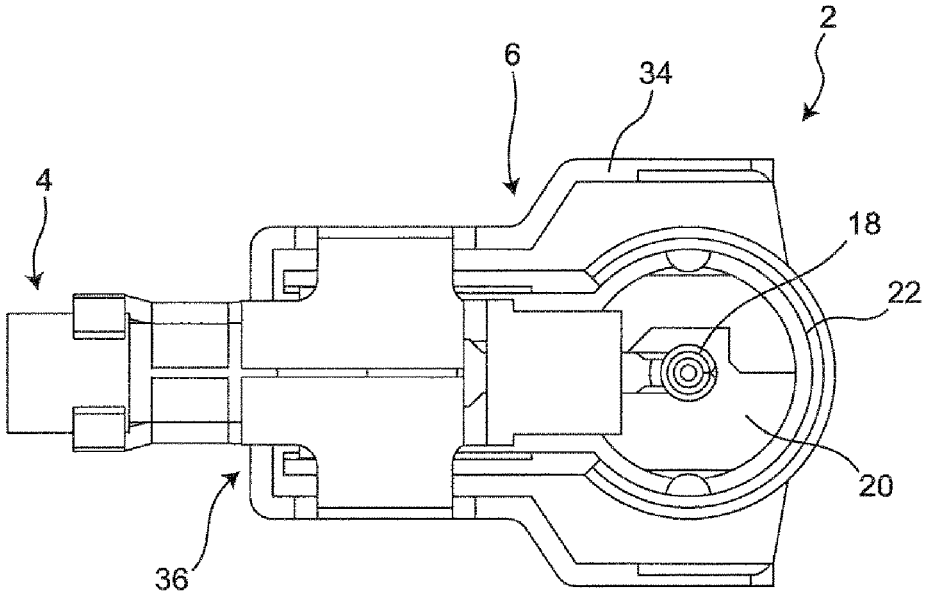
FIG. 3 is a plan view of the plug cable according to the first embodiment.
Figure 4:
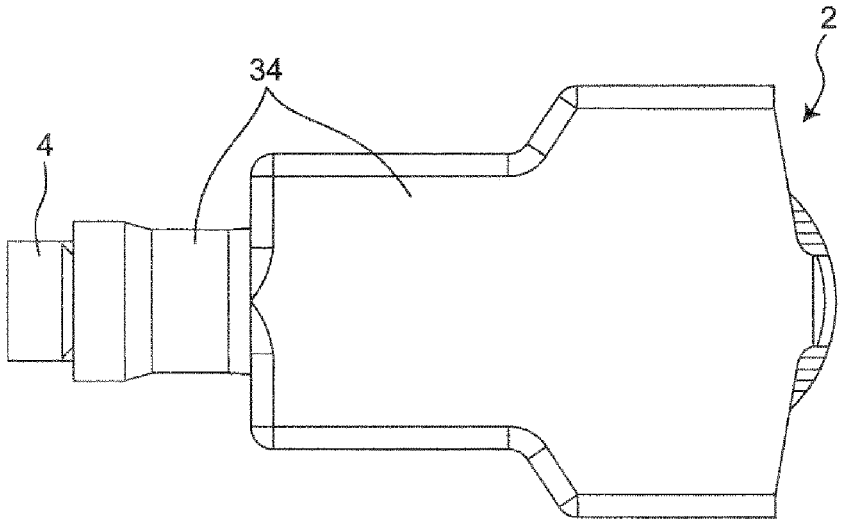
FIG. 4 is a rear view of the plug cable according to the first embodiment.
Figure 5:
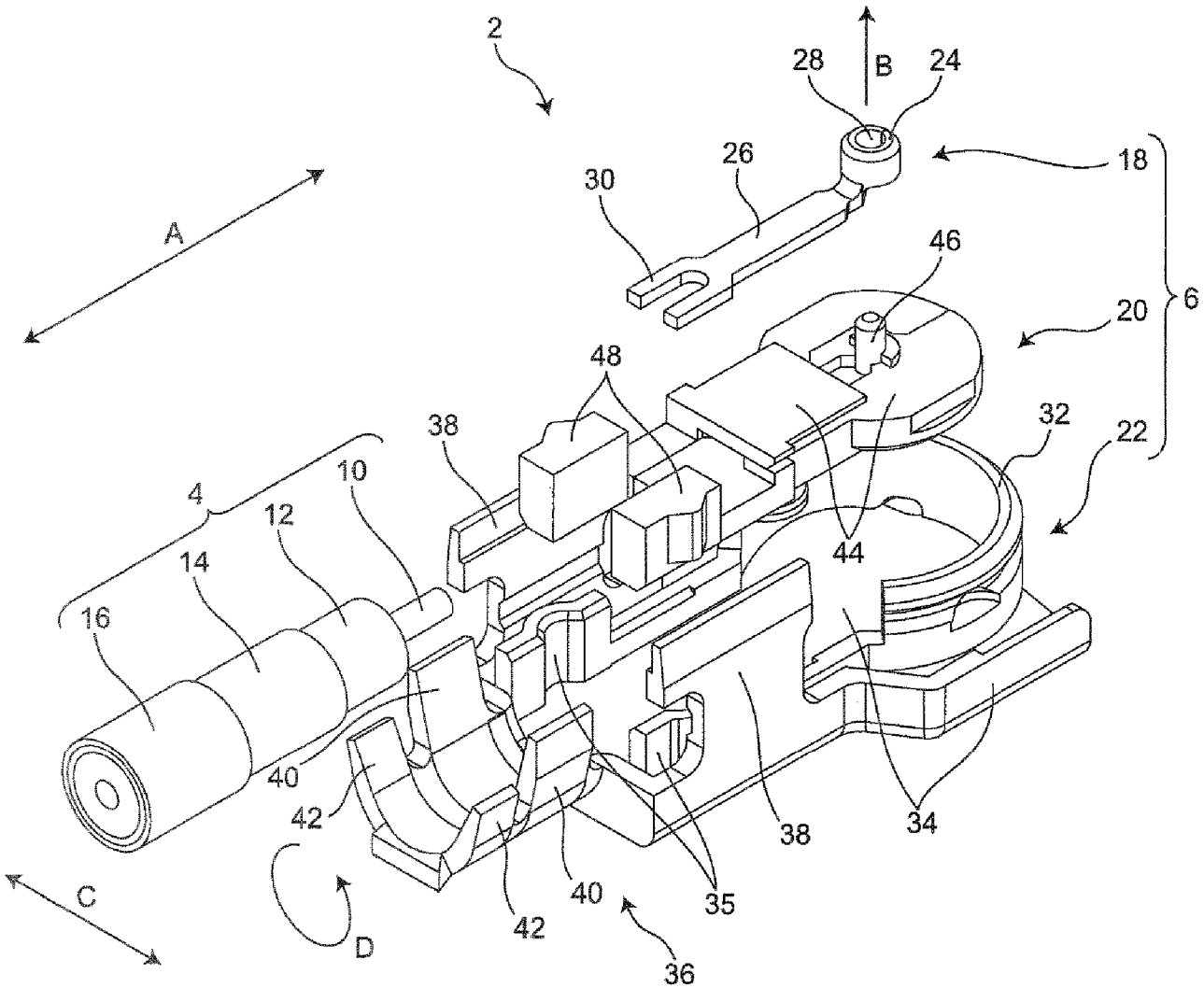
FIG. 5 is an exploded perspective view of the plug cable according to the first embodiment.
Figure 6:
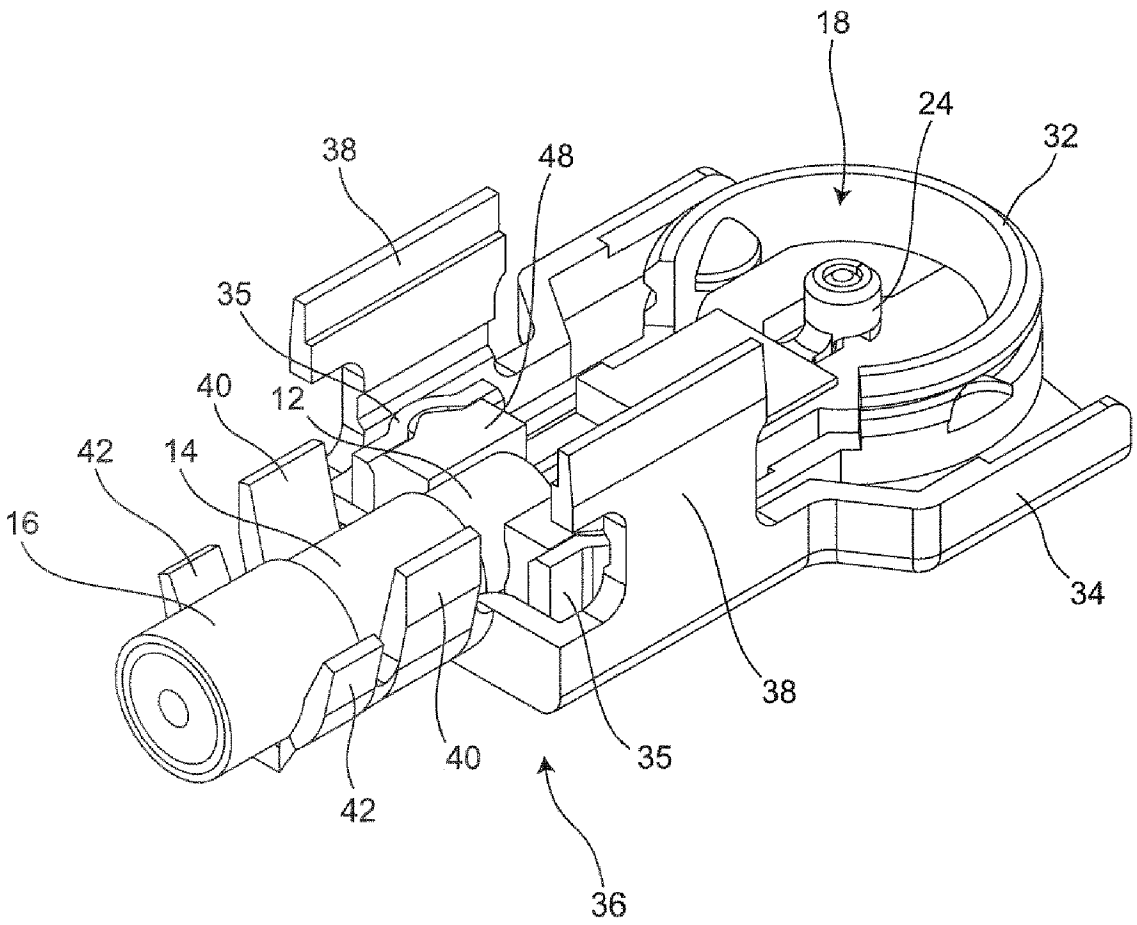
FIG. 6 is a perspective view illustrating a state before completion of the plug cable according to the first embodiment.
Figure 7:
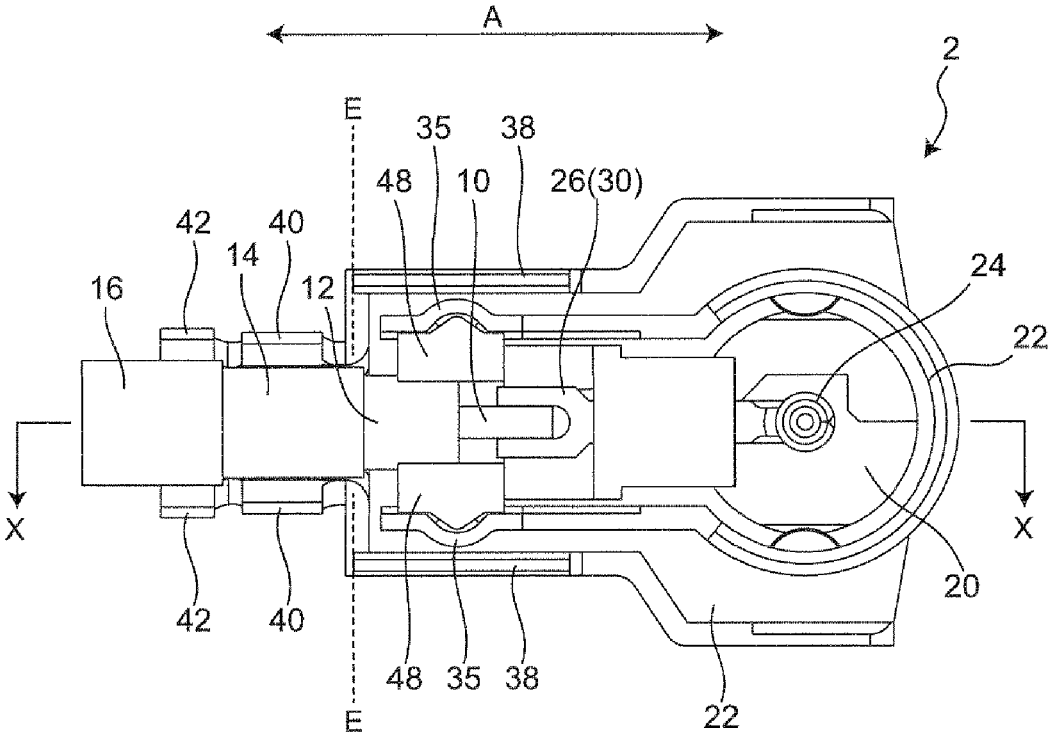
FIG. 7 is a plan view of FIG. 6.
Figure 8:
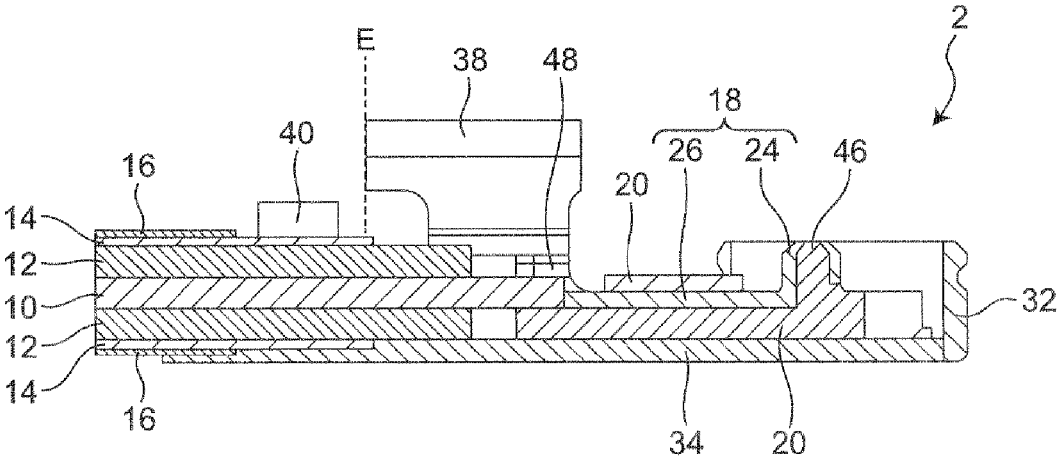
FIG. 8 an X-X plane view of FIG. 7.

Next, respective components of the plug cable 2 will be described with reference to FIGS. 1 and 3 to 8. FIG. 3 is a plan view of the plug cable 2, FIG. 4 is a rear view of the plug cable 2, and FIG. 5 is an exploded perspective view of the plug cable 2. FIG. 6 is a perspective view illustrating a state in which respective constituent elements illustrated in FIG. 5 are arranged in the plug cable 2 and are not fixed yet, and FIG. 7 is a plan view of FIG. 6, and FIG. 8 is a cross-sectional view taken along the line X-X in FIG. 7.

As illustrated in FIG. 5 and the like, the coaxial cable 4 includes a central conductor portion (core wire) 10, an insulator 12, an external conductor portion 14, and an insulating coating (outer cover) 16. In an axial direction A of the coaxial cable 4, the central conductor portion 10, the insulator 12, the external conductor portion 14, and the insulating coating 16 are exposed from a tip end side of the coaxial cable 4 in this order.

An internal terminal 18 of the L-shaped coaxial connector 6 to be described later is connected to the central conductor portion 10, and an external terminal 22 of the L-shaped coaxial connector 6 to be described later is connected to the external conductor portion 14.

The L-shaped coaxial connector 6 to which the coaxial cable 4 is connected includes the internal terminal (center pin) 18, an insulating member (bushing) 20, and the external terminal (housing) 22.

As described above, the internal terminal 18 is a terminal to be connected to the central conductor portion 10 of the coaxial cable 4. Similarly, the external terminal 22 is a terminal to be connected to the external conductor portion 14 of the coaxial cable 4. The internal terminal 18 and the external terminal 22 are electrically insulated from each other by the insulating member 20.

The internal terminal 18 according to the first embodiment is made of a single metal plate. Similarly, the external terminal 22 is also made of a single metal plate. The internal terminal 18 and the external terminal 22 are made of conductive members, and in the first embodiment, a surface of a copper alloy material is plated and formed with nickel and gold.

The insulating member 20 is disposed between the internal terminal 18 and the external terminal 22, and electrically insulates the internal terminal 18 and the external terminal 22 from each other. The insulating member 20 is formed of a resin such as a liquid crystal polymer as a main material, for example.

As illustrated in FIG. 5 and the like, the internal terminal 18 includes a first terminal portion 24 and a second terminal portion 26.

The first terminal portion 24 is a terminal portion to be inserted into the internal terminal 9 of the mating connector 8 described above. The first terminal portion according to the first embodiment is configured as a male type having a contact surface at an outer peripheral portion thereof. When the internal terminal 18 is a male type (pin type), the first terminal portion can be smaller than that in a case where the internal terminal 18 is made to be a female type (socket type) such as the internal terminal 9 of the mating connector 8.

The first terminal portion 24 in the first embodiment is configured as a substantially cylindrical member extending in an insertion direction B which is a direction orthogonal to an axial direction A of the coaxial cable 4.

In the first embodiment, an insertion hole 28 is provided in the first terminal portion 24. The insertion hole 28 is a hole for inserting a protruding portion 46 of the insulating member 20 to be described later. By inserting the protruding portion 46 into the insertion hole 28, strength deterioration of the first terminal portion 24 due to downsizing of the first terminal portion 24 can be suppressed, and the strength of the first terminal portion 24 can be reinforced. The more detailed shape of the first terminal portion 24 will be described later.

The second terminal portion 26 is a plate-like terminal portion extending in a lateral direction from the first terminal portion 24. The second terminal portion 26 is connected to the central conductor portion 10 of the coaxial cable 4 in an assembled state illustrated in FIGS. 6 and 7. The second terminal portion 26 in the first embodiment is a plate-like member which is perpendicular to the insertion direction B.

The forked portion 30 that is bifurcated is provided at a tip end of the second terminal portion 26. In the assembled state illustrated in FIGS. 6 and 7, the forked portion 30 is disposed so as to sandwich the central conductor portion 10 of the coaxial cable 4 in a width direction C. The width direction C is a direction perpendicular to both the axial direction A and the insertion direction B. The forked portion 30 and the central conductor portion 10 are fixed to each other by soldering.

Next, as illustrated in FIG. 5 and the like, the insulating member 20 includes a base portion 44, the protruding portion 46, and a tip end portion 48.

The base portion 44 is a member that serves as a base of the insulating member 20. The base portion 44 is housed in an external terminal 22 which is a housing. The protruding portion 46 and the tip end portion 48 are formed on the base portion 44.

The protruding portion 46 is a member that protrudes in the insertion direction B from the base portion 44. As described above, the protruding portion 46 is inserted into the insertion hole 28 of the first terminal portion 24 of the internal terminal 18 so as to reinforce the strength of the first terminal portion 24.

The tip end portion 48 is a member provided at the tip end of the base portion 44 in the axial direction A. In the first embodiment, the tip end portion 48 is provided as a pair of members spaced apart from each other in the width direction C.

The tip end portion 48 has a function of holding and fixing the coaxial cable 4 in contact with the insulator 12 of the coaxial cable 4 in the assembled state illustrated in FIGS. 6 and 7. In this manner, the tip end portion 48 has a function of holding a connection portion between the coaxial cable 4 and the internal terminal 18, that is, a connection portion between the central conductor portion 10 of the coaxial cable 4 and the forked portion 30 of the internal terminal 18.

Next, as illustrated in FIG. 5 and the like, the external terminal 22 includes a cylindrical portion 32, a holding portion 34, a fixing portion 35, and a crimping engagement portion 36 (FIG. 1).

The cylindrical portion 32 is a cylindrical member that is fitted to the external terminal 11 of the mating connector 8 described above. The cylindrical portion 32 in the first embodiment has a cylindrical shape (substantially cylindrical shape) extending in the insertion direction B. In the assembled state illustrated in FIG. 6 and FIG. 7, the first terminal portion 24 of the internal terminal 18 is disposed inside the cylindrical portion 32.

Since the cylindrical portion 32 of the external terminal 22 is cylindrical, and the first terminal portion 24 of the internal terminal 18 is also cylindrical, the cylindrical portion 32 and the first terminal portion 24 can maintain a certain distance from each other in a radial direction perpendicular to the insertion direction B, and a distance between them does not become locally narrow. As a result, it is possible to prevent a decrease in characteristic impedance due to an increase in capacitance of the cylindrical portion 32 and the first terminal portion 24, and consequently to prevent deterioration in reflection characteristics.

The holding portion 34 is a plate-like member extending laterally from the cylindrical portion 32. In the assembled state illustrated in FIGS. 6 and 7, the holding portion 34 is disposed along the insulating member 20 and the coaxial cable 4 to hold the insulating member 20 and the coaxial cable 4. The holding portion 34 is formed with the cylindrical portion 32, the fixing portion 35, and the crimping engagement portion 36 (see FIG. 1).

The fixing portion 35 is a plate-like member which is provided so as to protrude in the insertion direction B from the holding portion 34. In the assembled state illustrated in FIGS. 6 and 7, the fixing portion 35 is disposed so as to sandwich the tip end portion 48 of the insulating member 20 in the width direction C. The fixing portion 35 disposed in this manner has a function of fixing the tip end portion 48, and the coaxial cable 4 disposed inside the tip end portion 48.

The crimping engagement portion 36 is a member to be crimped toward the coaxial cable 4 and the insulating member 20. By crimping the crimping engagement portion 36, the coaxial cable 4 and the insulating member 20 are integrally fixed.

The crimping engagement portion 36 in the first embodiment is configured with a plurality of claw portions which are bent in a circumferential direction D of the coaxial cable 4 from the holding portion 34 toward the coaxial cable 4. Specifically, a first claw portion 38, a second claw portion 40, and a third claw portion 42 are provided. As illustrated in FIG. 5 and the like, each of the first claw portion 38, the second claw portion 40, and the third claw portion 42 is formed with a pair of plate-like members spaced apart from each other in the width direction C.

A function of each of the claw portions will be described with reference to FIGS. 6 and 7.

As illustrated in FIGS. 6 and 7, the first claw portion 38 is crimped so as to come into contact with the tip end portion 48 of the insulating member 20 located around the insulator 12 of the coaxial cable 4. The first claw portion 38 in contact with the tip end portion 48 has a function of holding and fixing a connection portion between the central conductor portion 10 of the coaxial cable 4 and the forked portion 30 of the internal terminal 18.

The second claw portion 40 is crimped so as to come into contact with the external conductor portion 14. The second claw portion 40 in contact with the external conductor portion 14 has a function of electrically connecting the external terminal 22 to the coaxial cable 4.

The third claw portion 42 is crimped so as to come into contact with the insulating coating 16 of the coaxial cable 4. The third claw portion 42 in contact with the insulating coating 16 has a function of holding and fixing the coaxial cable 4.

By crimping the first claw portion 38, the second claw portion 40, and the third claw portion 42, the plug cable 2 illustrated in FIG. 1 is manufactured. In the plug cable 2 illustrated in FIG. 1, the internal terminal 18 is connected to the central conductor portion 10 of the coaxial cable 4, and the external terminal 22 is held and fixed in a state in which the external terminal 22 is connected to the external conductor portion 14 of the coaxial cable 4. By fitting the L-shaped coaxial connector 6 of the plug cable 2 illustrated in FIG. 1 to the mating connector 8, the coaxial cable 4 connected to the L-shaped coaxial connector 6 and the substrate on which the mating connector 8 is mounted are electrically connected to each other, so that a high-frequency signal can be transmitted.

In such a configuration, as indicated by a dotted line E in FIGS. 7 and 8, the first claw portion 38 extends to a position at which the first claw portion 38 comes into contact with the external conductor portion 14 in the axial direction A of the coaxial cable 4. The dotted line E represents a position of a tip end of the first claw portion 38 in the axial direction A. By bringing the first claw portion 38 into contact with the external conductor portion 14, not only the second claw portion 40 but also the first claw portion 38 is electrically conducted with the external conductor portion 14. In this manner, the first claw portion 38 has another function that is electrically conducted with the external conductor portion 14 in addition to the function of holding and fixing the connection portion between the central conductor portion 10 and the forked portion 30 of the internal terminal 18 in contact with the tip end portion 48.

In contrast to the above configuration, it is considered that only the second claw portion 40 in the crimping engagement portion 36 contacts the external conductor portion 14, and the first claw portion 38 does not come into contact with the external conductor portion 14. In such a configuration, in the plug cable 2 after completion illustrated in FIG. 1, electric discontinuity may occur between the second claw portion 40 that is electrically conducted with the external conductor portion 14 and the first claw portion 38 that is not electrically conducted with the external conductor portion 14, and an electromagnetic field may be disturbed. As a result, electric characteristics of the plug cable 2 may deteriorate.

In the plug cable 2 according to the first embodiment, not only the second claw portion 40 but also the first claw portion 38 is in contact and is electrically conducted with the external conductor portion 14. Therefore, it is possible to prevent electric discontinuity in the axial direction A from occurring in the external terminal 22. As illustrated in FIG. 1, although there is a space between the first claw portion 38 and the second claw portion 40, since the external conductor portion 14 is disposed in this space, no electric discontinuity is generated. With such a configuration, the electric characteristics of the plug cable 2 can be improved, and the high-frequency signal can be stably transmitted.

In the first embodiment, as illustrated in FIG. 8, a portion where the first claw portion 38 contacts the tip end portion 48 of the insulating member 20 is set to a distance farther from the holding portion 34 of the external terminal 22 than a portion where the first claw portion 38 contacts the external conductor portion 14. Specifically, a height position of the tip end portion 48 of the insulating member 20 is made lower than a height position of the external conductor portion 14. According to this disposal, when the first claw portion 38 contacting the tip end portion 48 is extended in the axial direction A to make contact with the external conductor portion 14, the first claw portion 38 can be brought into contact with the external conductor portion 14 in such a manner as to be pressed against the external conductor portion 14. Thus, it is possible to reliably secure the contact between the first claw portion 38 and the external conductor portion 14 while using a simple configuration.

In the plug cable 2 having the above-described configuration, as illustrated in FIG. 8, the protruding portion 46 of the insulating member 20 is inserted into the first terminal portion 24 of the internal terminal 18. Thus, the internal terminal 18 is reinforced from the inside, and the strength of the internal terminal 18 is improved.

In the first embodiment, as described above, the internal terminal 18 is provided with the first terminal portion 24, and is made to be the male type that is inserted into the internal terminal 9 of the mating connector 8. Accordingly, it is not necessary to ensure springiness like a female type, and the internal terminal 18 can be made small. Even when the internal terminal 18 is made smaller, the protruding portion 46 of the insulating member 20 is inserted into and engaged with the insertion hole 28 of the first terminal portion 24, so that the strength of the internal terminal 18 is reinforced. As a result, it is possible to suppress reduction in strength due to downsizing of the internal terminal 18. In this manner, by reducing an overall shape of the internal terminal 18, it is possible to suppress capacitance coupling between the internal terminal 18 and the external terminal 22 disposed around the internal terminal 18, thereby suppressing deterioration in electric characteristics, and at the same time, downsizing the plug cable 2, and in particular lowering a height of the plug cable 2.

Figure 9A:
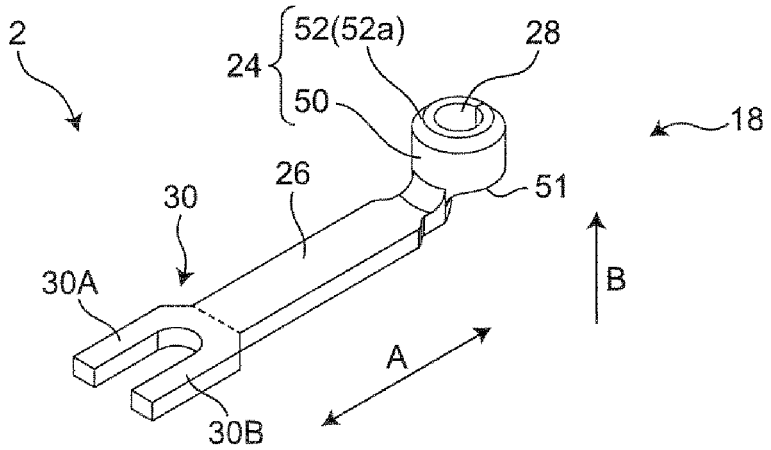
FIG. 9A is a perspective view of an internal terminal to be used in the plug cable according to the first embodiment.
Figure 9B:
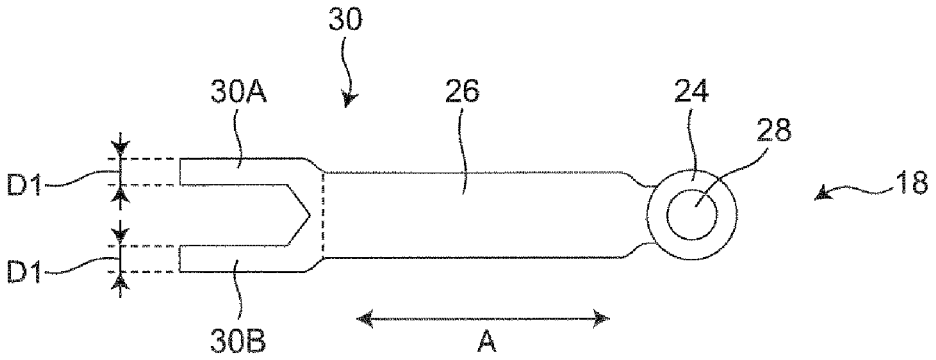
FIG. 9B is a plan view of the internal terminal to be used in the plug cable according to the first embodiment.

Next, a detailed configuration of the internal terminal 18 will be described with reference to FIGS. 9A to 9C. FIG. 9A is a perspective view of the internal terminal 18, FIG. 9B is a plan view of the internal terminal 18, and FIG. 9C is a longitudinal sectional view of the internal terminal 18 (corresponding to the X-X cross section in FIG. 7).

Figure 9C:
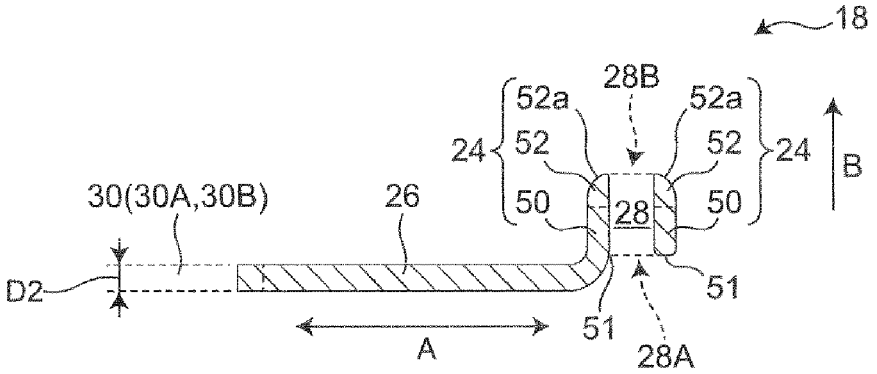
FIG. 9C is a longitudinal sectional view of the internal terminal to be used in the plug cable according to the first embodiment.

As illustrated in FIGS. 9A and 9C, the first terminal portion 24 of the first embodiment is formed in a cylindrical shape having a rounded tip end. Specifically, the first terminal portion 24 includes a cylinder portion 50 and a convex portion 52.

The cylinder portion 50 is a cylindrical member, and one side thereof is connected to the second terminal portion 26, and the other side thereof is connected to the convex portion 52. The convex portion 52 is a member protruding in the insertion direction B from the cylinder portion 50. The convex portion 52 configures a tip end portion of the first terminal portion 24 in the insertion direction B.

The convex portion 52 in the first embodiment forms a curved surface 52*a*. The surface 52*a* is a surface continuous from an outer peripheral surface of the cylinder portion 50, and is smoothly curved toward a center side of the first terminal portion 24. By forming this surface 52*a*, the tip end portion of the first terminal portion 24 is formed into a rounded shape rather than an angular shape. By forming not only the cylinder portion 50 but also the convex portion 52 in a rounded shape, it is possible to suppress capacitance coupling between the internal terminal 18 and the external terminal 22 provided around the internal terminal 18 as compared with a case where the cylinder portion is formed into an angular shape, and thus it is possible to suppress deterioration in electric characteristics of the plug cable 2.

Further, in the first embodiment, the insertion hole 28 is formed as a through-hole which penetrates both of the cylinder portion 50 and the convex portion 52 in the insertion direction B. By forming the insertion hole 28 as a through-hole, two cavity portions 28A and 28B are formed at both ends, in the insertion direction B, of the first terminal portion 24 (FIG. 9C). The first cavity portion 28A is formed in the cylinder portion 50, and the second cavity portion 28B is formed in the convex portion 52. The first cavity portion 28A is formed on the base end portion 51 of the first terminal portion 24, and the second cavity portion 28B is formed on the top end portion (convex portion 52) of the first terminal portion 24.

In FIG. 9C, the first cavity portion 28A and the second cavity portion 28B are illustrated as having the same diameter, but FIG. 9C is a schematic diagram and the first cavity portion 28A and the second cavity portion 28B are not limited to having the same diameter. For example, as illustrated in FIG. 8, the diameter of the first cavity portion 28A may be larger than the diameter of the second cavity portion 28B.

The first cavity portion 28A is an insertion opening for inserting the protruding portion 46 of the insulating member 20 described above. On the other hand, the second cavity portion 28B is a hole for preventing the protruding portion 46 from interfering with the tip end portion of the first terminal portion 24 even when a length of the protruding portion 46, of the insulating member 20, to be inserted is set to be long. By forming the insertion hole 28 as a through-hole in this manner, the length of the protruding portion 46 of the insulating member 20 can be lengthened, and the strength of the first terminal portion 24 can be further reinforced.

Further, in the first embodiment, the entire protruding portion 46 of the insulating member 20 is housed in the insertion hole 28 of the first terminal portion 24. Specifically, the tip end of the protruding portion 46 extends to the same position as a tip end (tip end portion) of the convex portion 52 of the first terminal portion 24 in the insertion direction B (refer to FIG. 8). By disposing the protruding portion 46 substantially over the entire length in the insertion direction B in the first terminal portion 24 of the internal terminal 18, the protruding portion 46 is prevented from protruding from the insertion hole 28, and the strength of the first terminal portion 24 is reinforced to a maximum possible extent while interference with the other members is being prevented.

Next, the forked portion 30 provided at a tip end of the second terminal portion 26 will be described.

In the first embodiment, the forked portion 30 is formed in the second terminal portion 26, and is configured so as to sandwich the central conductor portion 10 of the coaxial cable 4 described above. The second terminal portion 26 can be connected to the central conductor portion 10 with a simple configuration by using the forked portion 30 to be connected with the central conductor portion 10. Moreover, the forked portion 30 is a portion extending in the axial direction A in the same manner as the central conductor portion 10 and does not have any irregularities in a vertical direction (the insertion direction B). According to this configuration, a contact area can be secured larger than that in a case where the forked portion 30 is bifurcated not in the axial direction A but in the vertical direction and is in contact with the central conductor portion 10. Further, the capacitive coupling with the external terminal 22 can also be suppressed because the forked portion 30 has no irregularity in the vertical direction.

Further, in the first embodiment, a first extension portion 30A and a second extension portion 30B of the forked portion 30 have the same and constant width, and the same and constant thicknesses with each other.

Specifically, as illustrated in FIG. 9B, the widths of the first extension portion 30A and the second extension portion 30B are a length D1 and are equal to each other, and are also constant in the axial direction A. Similarly, as illustrated in FIG. 9C, the thicknesses of the first extension portion 30A and the second extension portion 30B are a length D2 and are equal to each other, and are also constant in the axial direction A.

According to this configuration, compared to a case where the widths and thicknesses of the first extension portion 30A and the second extension portion 30B are different or are not constant, the capacitance coupling with the external terminal 22 can be suppressed, so that the deterioration in the electric characteristics of the plug cable 2 can be suppressed.

Second Embodiment

A plug cable and an L-shaped coaxial connector according to a second embodiment of the present disclosure will now be described. Note that, in the second embodiment, a description will be mainly given of points different from the first embodiment. Further, a description that overlaps with the first embodiment will be omitted.

Figure 10:
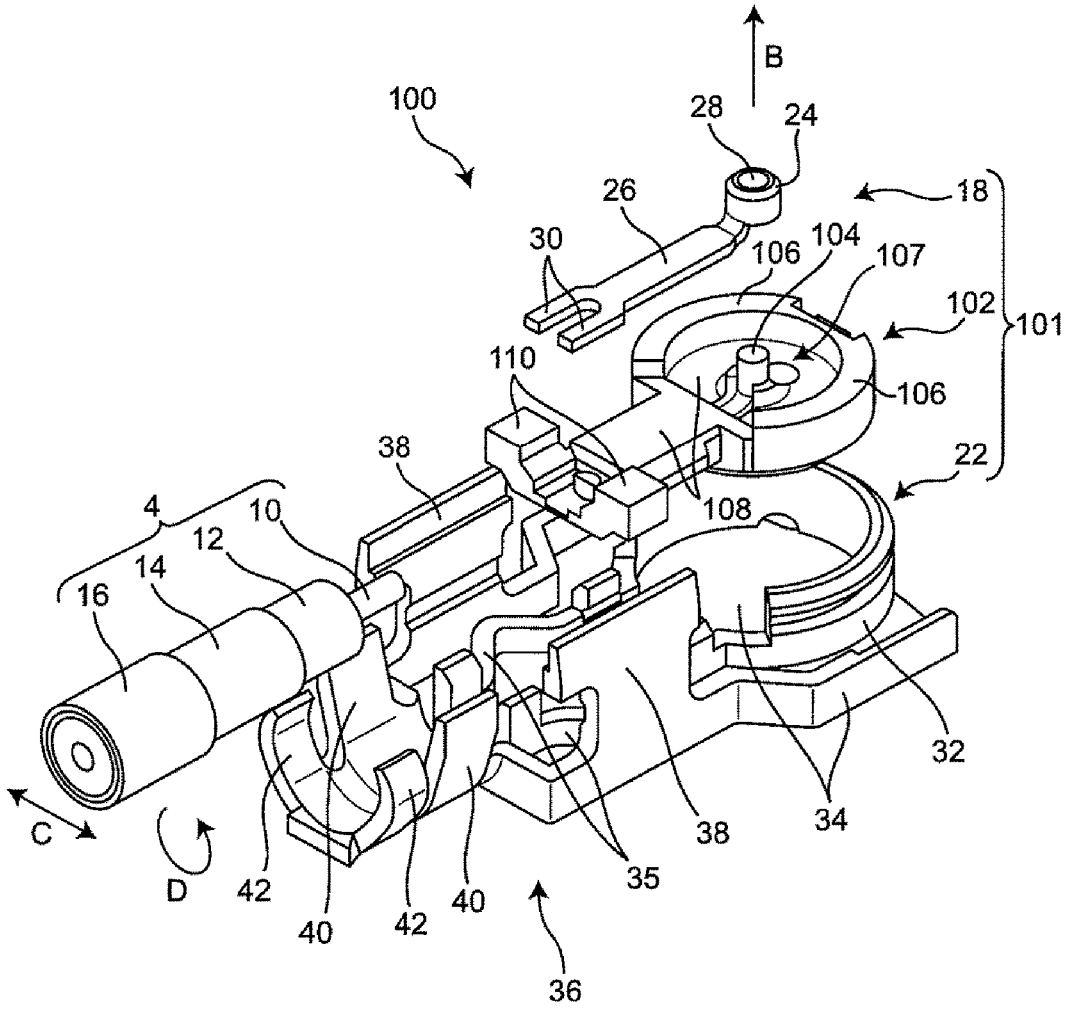
FIG. 10 is an exploded perspective view of a plug cable and an L-shaped coaxial connector according to a second embodiment.
Figure 11:
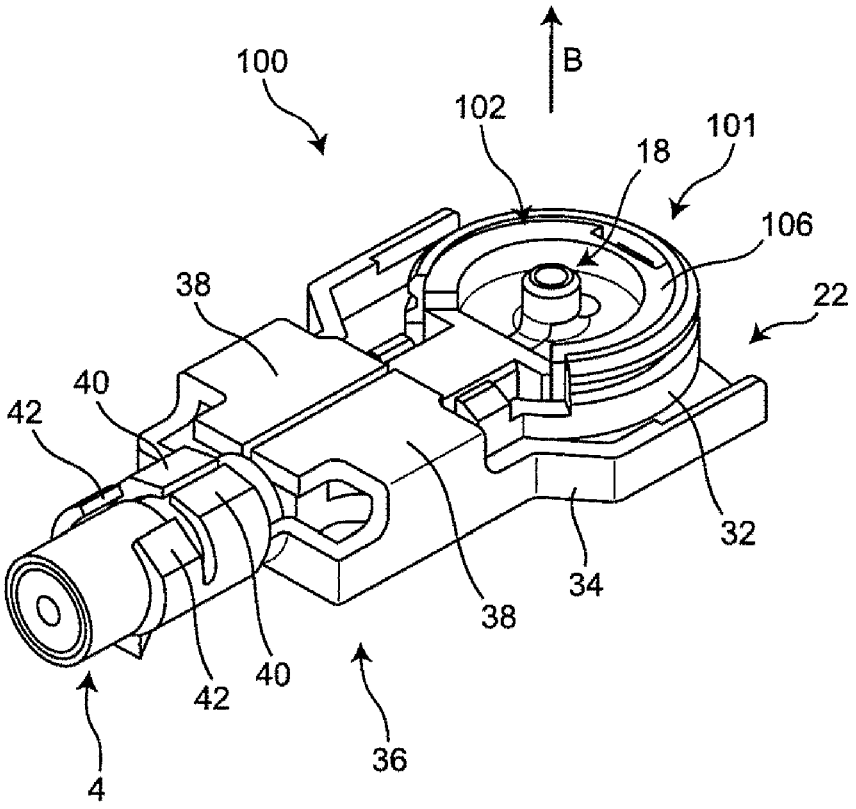
FIG. 11 is a perspective view of the plug cable and the L-shaped coaxial connector according to the second embodiment.

FIGS. 10 and 11 are an exploded perspective view and a perspective view of a plug cable 100 and an L-shaped coaxial connector 101 of the second embodiment, respectively. Similarly to the L-shaped coaxial connector 2 according to the first embodiment, the L-shaped coaxial connector 100 according to the second embodiment includes the coaxial cable 4, the internal terminal 18, and the external terminal 22. Since configurations of the coaxial cable 4, the internal terminal 18 and the external terminal 22 are the same as those in the first embodiment, descriptions thereof will be omitted.

As illustrated in FIG. 10, in the second embodiment, a shape of an insulating member 102 in the L-shaped coaxial connector 101 is mainly different from that in the first embodiment.

The insulating member 102 illustrated in FIG. 10 includes a protruding portion 104, an outer frame portion 106, a base portion 108, and a tip end portion 110.

The outer frame portion 106 is a member that configures a part of an outer frame of the insulating member 102. The outer frame portion 106 of the second embodiment is formed in a substantially cylindrical shape, and is connected to the base portion 108. In an assembled state illustrated in FIG. 11, the outer frame portion 106 is press-fitted and fixed to the cylindrical portion 32 of the external terminal 22. That is, an outer diameter of the outer frame portion 106 is set to be substantially the same as an inner diameter of the cylindrical portion 32 such that the outer frame portion 106 can be press-fitted into the cylindrical portion 32.

Figure 12:
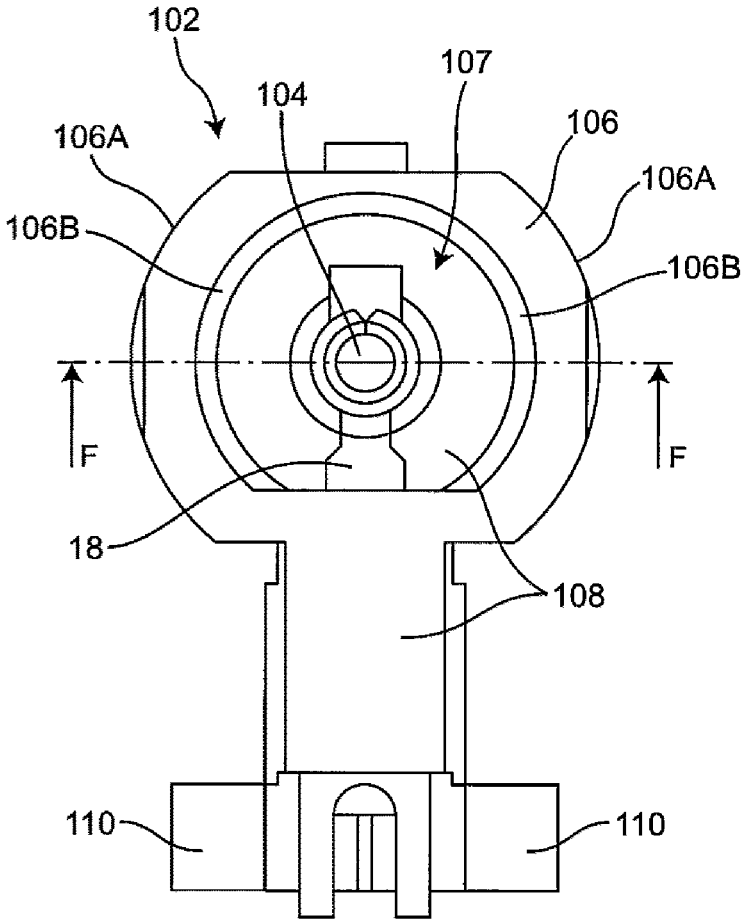
FIG. 12 is a plan view illustrating an insulating member and an internal terminal.
Figure 13:
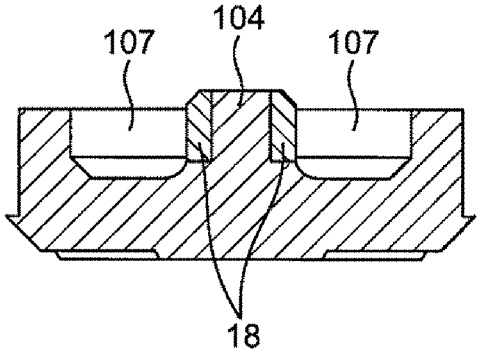
FIG. 13 is a cross-sectional view taken along a line F-F of FIG. 12.

Enlarged views of the insulating member 102 and the internal terminal 18 are illustrated in FIG. 12 and FIG. 13, respectively. FIG. 12 is a plan view of the insulating member 102 and the internal terminal 18, and FIG. 13 is a cross-sectional view taken along the line F-F in FIG. 12.

As illustrated in FIG. 12 and FIG. 13, a recess 107 is formed between the outer frame portion 106 and the protruding portion 104. The recess 107 is a space above the base portion 108. Each of the recess 107, the protruding portion 104, and the outer frame portion 106 is formed in a concentric circle.

According to this configuration, a thickness of the outer frame portion 106 is adjusted, by changing a position of an inner peripheral surface 106B of the outer frame portion 106 while maintaining a shape of an outer peripheral surface 106A of the outer frame portion 106. As a result, impedance adjustment of the L-shaped coaxial connector 101 can be performed. Since the outer peripheral surface 106A of the outer frame portion 106 is press-fitted into the cylindrical portion 32 of the external terminal 22 described above, press-fitting into the cylindrical portion 32 is performed with high accuracy by maintaining the shape and position of the outer peripheral surface 106A. On the other hand, since the inner peripheral surface 106B of the outer frame portion 106 is free from restriction that the outer peripheral surface 106A has, the outer frame portion 106 can be press-fitted into the cylindrical portion 32 even when a position, and in particular, a radial position thereof are changed. By changing the position of the inner peripheral surface 106B, the thickness of the outer frame portion 106 is changed, whereby an impedance of the entire L-shaped coaxial connector 101 is changed.

As described above, by adjusting the position of the inner peripheral surface 106B while maintaining the shape of the outer peripheral surface 106A of the outer frame portion 106, it is possible to easily adjust the impedance of the L-shaped coaxial connector 101 without changing an outer shape of the external terminal 22.

In particular, since the insulating member 106 is molded from a resin, it has a higher degree of freedom in shape than a metal or the like, and is suitable for adjustment of impedance.

Next, characteristics of a method for manufacturing the plug cable 100 and the L-shaped coaxial connector 101 according to the second embodiment will be described.

Figure 14A:
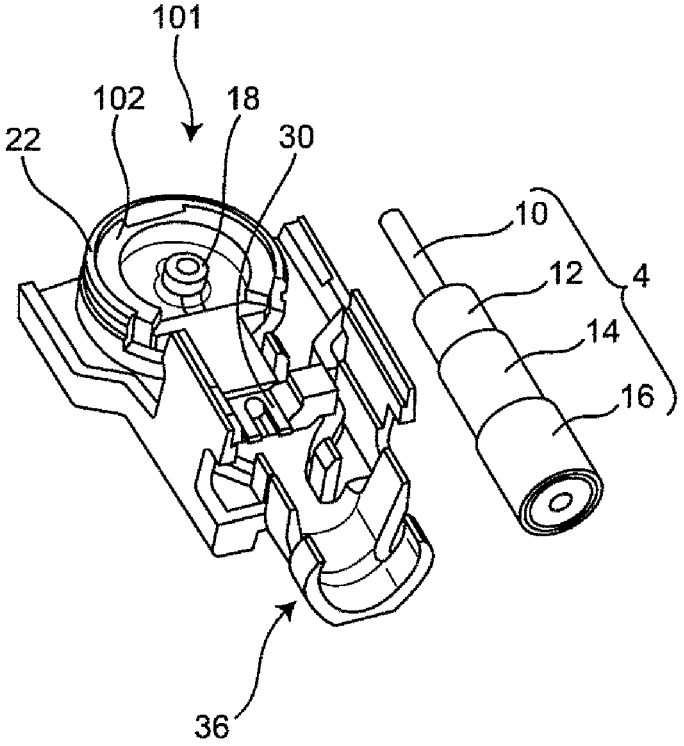
FIG. 14A is a perspective view for explaining a method for manufacturing the plug cable and the L-shaped coaxial connector according to the second embodiment.

As illustrated in FIG. 14A, first, the coaxial cable 4 and the internal terminal 18 having the forked portion 30 are prepared. The internal terminal 18 has already been assembled together with the external terminal 22 and the insulating member 102. Specifically, the internal terminal 18 has been positioned by the insulating member 102, and the insulating member 102 has been press-fitted and fixed to the external terminal 22. The crimping engagement portion 36 is in a state before being crimped, and is opened so as to receive the coaxial cable 4.

Next, the coaxial cable 4 is connected to the internal terminal 18 and the external terminal 22. Specifically, the coaxial cable 4 is moved toward the internal terminal 18 and the external terminal 22, and as illustrated in FIG. 14B, the central conductor portion 10 of the coaxial cable 4 is connected to the forked portion 30 of the internal terminal 18, and the external conductor portion 14 is connected to the crimping engagement portion 36.

Figure 14B:
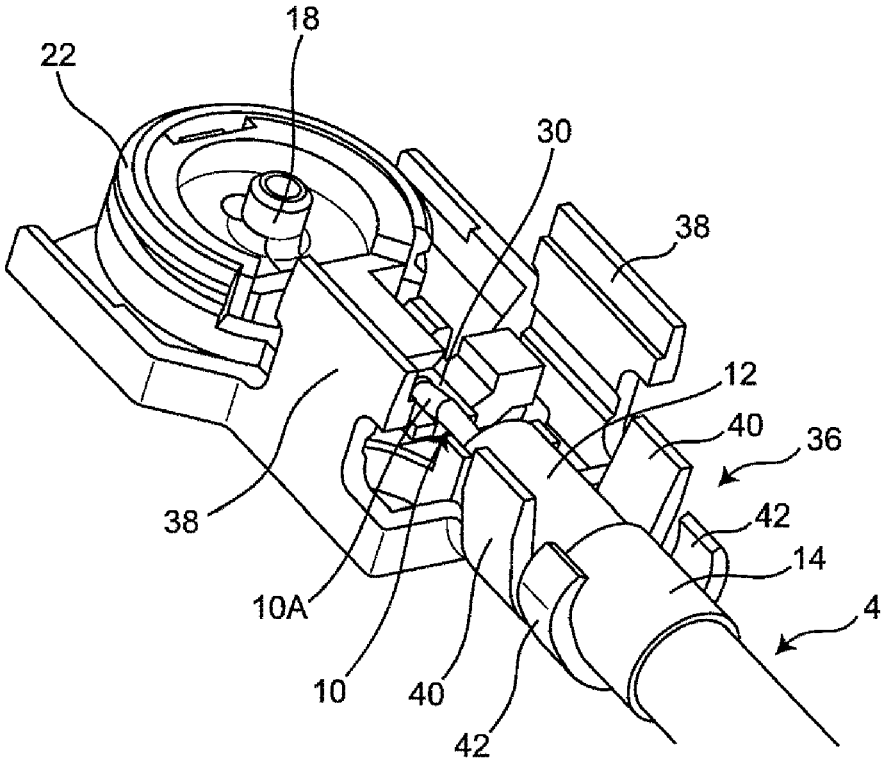
FIG. 14B is a perspective view for explaining the method for manufacturing the plug cable and the L-shaped coaxial connector according to the second embodiment.

As illustrated in FIG. 14B, the central conductor portion 10 is caught in a gap of the forked portion 30 of the internal terminal 18. In particular, in the second embodiment, an inclined portion 10A which is a tip end portion of the central conductor portion 10 is bent toward the gap of the forked portion 30. Specifically, the coaxial cable 4 in which the inclined portion 10A is formed by bending the tip end portion of the central conductor portion 10 is inserted into the gap in the forked portion 30. Thus, the central conductor portion 10 can be reliably connected to the forked portion 30 of the internal terminal 18.

A portion, of the central conductor portion 10, excluding the inclined portion 10A extends along the axial direction A of the coaxial cable 4, while the inclined portion 10A is inclined in a direction intersecting the axial direction A of the coaxial cable 4. Although a case where the inclined portion 10A is the tip end portion of the central conductor portion 10 is described in the second embodiment, the present disclosure is not limited to such a case, and the inclined portion 10A may be formed in a middle portion other than the tip end portion of the central conductor portion 10, or the like.

Figure 14C:
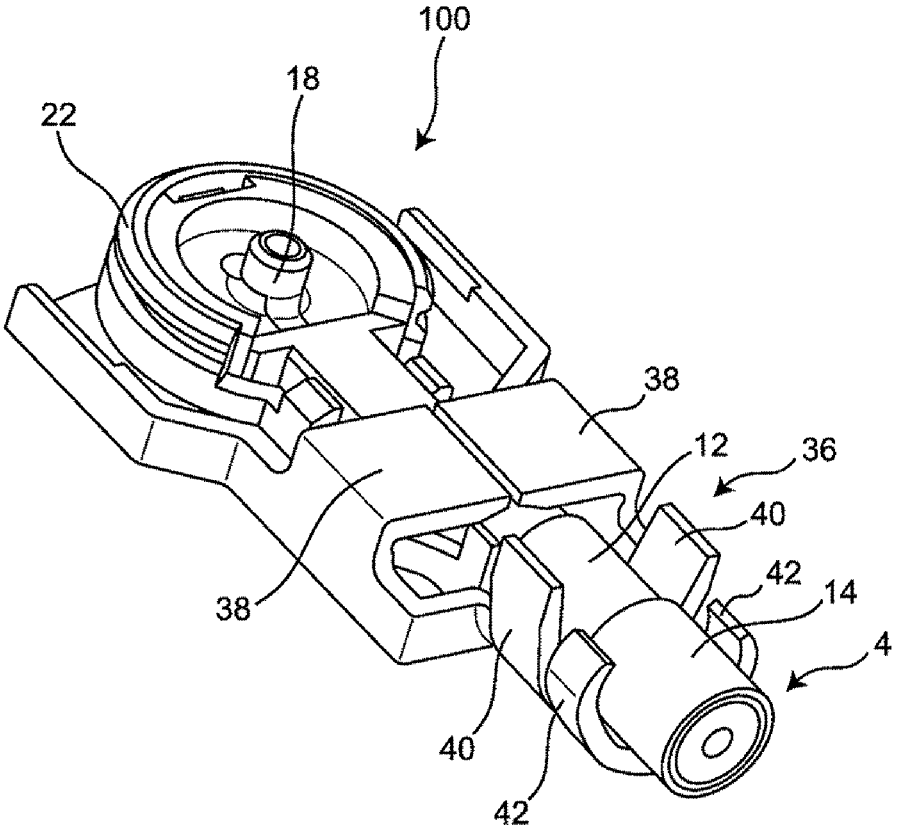
FIG. 14C is a perspective view for explaining the method for manufacturing the plug cable and the L-shaped coaxial connector according to the second embodiment.

Next, the crimping engagement portion 36 is crimped. Specifically, each portion of the crimping engagement portion 36 is crimped in a circumferential direction by using a predetermined tool. In a state illustrated in FIG. 14C, only the first crimping engagement portion 38 of the crimping engagement portion 36 is crimped. By crimping the first crimping engagement portion 38, a connection state between the central conductor portion 10 and the forked portion 30 can be firmly maintained.

Thereafter, the second crimping engagement portion 40 and the third crimping engagement portion 42 in the crimping engagement portion 36 are crimped. Thus, the coaxial cable 4 is firmly connected to the L-shaped coaxial connector 101, and the plug cable 100 which is an L-shaped coaxial connector having a coaxial cable is completed.

Although the present disclosure has been described with reference to the first and second embodiments described above, the present disclosure is not limited to the first and second embodiments described above. For example, in the first and second embodiments, a case where the external terminal 22 includes the cylindrical portion 32 having a cylindrical shape and the first terminal portion 24 of the internal terminal 18 disposed in the cylindrical portion 32 includes the cylinder portion 50 has been described, but the present disclosure is not limited to such a case. Each of cross sections of the cylindrical portion 32 and the cylinder portion 50 is not limited to a circular shape, and may have an arbitrary shape. That is, any cylindrical shape may be used. Note that when both cross sections of the cylindrical portion 32 and the cylinder portion 50 have a circular shape, it is possible to suppress electrical capacitance coupling to each other.

As used herein, the term "cylindrical" includes not only a complete cylindrical shape but also a cylindrical shape being added with irregularities, a cutout portion, a protruding portion, and the like (generally cylindrical shape, substantially cylindrical shape, about cylindrical shape, and the like).

Moreover, in the first and second embodiments, a case where a direction in which the first terminal portion 24 of the internal terminal 18 and the cylindrical portion 32 of the external terminal 22 extend (the insertion direction B) is orthogonal to the axial direction A of the coaxial cable 4 has been described, but the present disclosure is not limited to such a case, and a case where the direction is not orthogonal to the axial direction A may be applicable. That is, the first terminal portion 24 and the cylindrical portion 32 may extend in a direction intersecting the axial direction A of the coaxial cable 4.

In the first and second embodiments, a case where the insertion hole 28 provided in the first terminal portion 24 is a through-hole has been described, but the present disclosure is not limited thereto, and it is sufficient that only the first cavity portion 28A on one side is opened, and the second cavity portion 28B on the other side may be closed. That is, it is sufficient that at least the protruding portion 46 of the insulating member 20 can be inserted. In other words, the insertion hole 28 may be provided in the base end portion 51 on the opposite side to the tip end portion located at the tip end in the insertion direction B. In addition, when the insertion hole 28 is used as a through-hole, the length of the protruding portion 46 to be inserted can be lengthened, and the strength of the first terminal portion 24 can be further secured.

In addition, in the first and second embodiments, a case where the protruding portion 46 of the insulating member 20 extends to the same position as the tip end portion (convex portion 52) of the first terminal portion 24 has been described, but the present disclosure is not limited to such a case, and a case where the protruding portion 46 further protrudes from the first terminal portion 24 or is completely housed in the first terminal portion 24 may be applicable. When the protruding portion 46 is not further protruded from the first terminal portion 24 but is housed in the first terminal portion 24, it is possible to prevent interference with other members.

Although the forked portion 30 is provided at the tip end of the second terminal portion 26 in the first and second embodiments, and is brought into contact with the central conductor portion 10 of the coaxial cable 4 in the axial direction A, the present disclosure is not limited to such a case, and a configuration different from the forked portion 30 may be brought into contact with the central conductor portion 10. It is to be noted that it is possible to secure a contact area with the central conductor portion 10 by providing a forked portion 30 which is engaged with the central conductor portion 10 in the axial direction A, and thus it is possible to obtain good electric characteristics.

In the first and second embodiments, a case where the first extension portion 30A and the second extension portion 30B in the forked portion 30 have the same and constant (D1) width, and also have the same and constant (D2) thickness has been described, but the present disclosure is not limited to such a case and they may not have the same and constant widths or the same and constant thicknesses. It is to be noted that better electric characteristics can be obtained by making them have the same and constant widths and the same and constant thicknesses.

In the first and second embodiments, a case where a portion where the first claw portion 38 contacts the tip end portion 48 of the insulating member 20 is set to a distance farther from the holding portion 34 than a portion where the first claw portion 38 contacts the external conductor portion 14 has been described, but the present disclosure is not limited to this case, and the opposite relationship may be applicable. It should be noted that a contact between the first claw portion 38 and the external conductor portion 14 can be secured with a simple configuration when a portion where the first claw portion 38 comes into contact with the tip end portion 48 of the insulating member 20 is set at a farther distance or the same distance from the holding portion 34 than a portion where the first claw portion 38 comes into contact with the external conductor portion 14.

Although the present disclosure has been fully described in connection with preferred embodiments with reference to the accompanying drawings, various variations and modifications will be apparent to those skilled in the art. It is to be understood that such variations and modifications are included within the scope of the present disclosure as defined by the appended claims, as long as they do not depart from the scope of the present disclosure. The combination of elements and the change in order of the elements in the embodiments can be realized without departing from the scope and spirit of the present disclosure.

It should be noted that any of the various embodiments and modifications described above may be combined appropriately with each other to exhibit the effects of the various embodiments and modifications.

The present disclosure is applicable to an L-shaped coaxial connector having a coaxial cable.

What is claimed is:

1. An L-shaped coaxial connector comprising:

a coaxial cable including a central conductor portion and an external conductor portion disposed around the central conductor portion;

an internal terminal connected to the central conductor portion of the coaxial cable, the internal terminal including a first terminal portion that is a male type, that has a cylindrical shape, and that extends in the direction intersecting an axial direction of the coaxial cable, and a second terminal portion extending to connect from the first terminal portion to the central conductor portion of the coaxial cable;

an external terminal connected to the external conductor portion of the coaxial cable, the external terminal including a cylindrical portion surrounding the first terminal portion and extending in a cylindrical shape in a direction intersecting the axial direction of the coaxial cable;

an insulating member disposed between the internal terminal and the external terminal, the insulating member including a protruding portion configured to insert into the first terminal portion; and when a side into which the insulating member is inserted is defined as a base end portion, and an end portion on a side opposite to the base end portion is defined as a tip end portion, the first terminal portion includes a through-hole extending from the base end portion to the tip end portion.

2. The L-shaped coaxial connector according to claim 1, wherein the insulating member further includes an outer frame portion disposed inside the cylindrical portion of the external terminal and surrounding the protruding portion, and a recess is formed between the outer frame portion and the protruding portion.

3. The L-shaped coaxial connector according to claim 1, wherein the protruding portion of the insulating member is housed in the first terminal portion.

4. The L-shaped coaxial connector according to claim 3, wherein the protruding portion of the insulating member extends to a same position as the tip end portion in an axial direction of the first terminal portion.

5. The L-shaped coaxial connector according to claim 1, wherein the second terminal portion of the internal terminal includes a forked portion that is bifurcated at a tip end of the second terminal portion, and the forked portion is disposed to sandwich the central conductor portion.

6. The L-shaped coaxial connector according to claim 5, wherein the forked portion includes a first extension portion and a second extension portion that have a same and constant width and a same and constant thickness with each other.

7. The L-shaped coaxial connector according to claim 5, wherein the central conductor portion has an inclined portion inclined in a direction intersecting the axial direction of the coaxial cable, and the forked portion is disposed to sandwich the inclined portion.

8. The L-shaped coaxial connector according to claim 1, wherein the cylindrical portion of the external terminal is cylindrical;

the first terminal portion is cylindrical, and when a side into which the insulating member is inserted is defined as a base end portion, and an end portion on a side opposite to the base end portion is defined as a tip end portion, a convex portion forming a curved surface is provided at the tip end portion.

9. The L-shaped coaxial connector according to claim 8, wherein the second terminal portion of the internal terminal includes a forked portion that is bifurcated at a tip end of the second terminal portion, and the forked portion is disposed to sandwich the central conductor portion.

10. An L-shaped coaxial connector, the L-shaped coaxial connector being configured to connect to a coaxial cable including a central conductor portion and an external conductor portion disposed around the central conductor portion, the L-shaped coaxial connector comprising:

an internal terminal configured to connect to the central conductor portion of the coaxial cable, the internal terminal including a first terminal portion that is a male type, that has a cylindrical shape, and that extends in the direction intersecting an axial direction of the coaxial cable, and a second terminal portion extending to connect from the first terminal portion to the central conductor portion of the coaxial cable;

an external terminal configured to connect to the external conductor portion of the coaxial cable, the external terminal including a cylindrical portion surrounding the first terminal portion and extending in a cylindrical shape in a direction intersecting the axial direction of the coaxial cable;

an insulating member disposed between the internal terminal and the external terminal, the insulating member including a protruding portion configured to insert into the first terminal portion; and when a side into which the insulating member is inserted is defined as a base end portion, and an end portion on a side opposite to the base end portion is defined as a tip end portion, the first terminal portion includes a through-hole extending from the base end portion to the tip end portion.

11. The L-shaped coaxial connector according to claim 10, wherein the cylindrical portion of the external terminal is cylindrical, the first terminal portion is cylindrical, and when a side into which the insulating member is inserted is defined as a base end portion, and an end portion on a side opposite to the base end portion is defined as a tip end portion, a convex portion forming a curved surface is provided at the tip end portion.

12. The L-shaped coaxial connector according to claim 10, wherein the protruding portion of the insulating member is housed in the first terminal portion.

13. The L-shaped coaxial connector according to claim 12, wherein the protruding portion of the insulating member extends to a same position as the tip end portion in an axial direction of the first terminal portion.

14. The L-shaped coaxial connector according to claim 10, wherein the second terminal portion of the internal terminal has a forked portion that is bifurcated at a tip end of the second terminal portion, and the forked portion is disposed so as to sandwich the central conductor portion.

15. The L-shaped coaxial connector according to claim 14, wherein the forked portion includes a first extension portion and a second extension portion that have a same and constant width, and a same and constant thickness with each other.

16. The L-shaped coaxial connector according to claim 14, wherein the insulating member further includes an outer frame portion disposed inside the cylindrical portion of the external terminal and surrounding the protruding portion, and a recess is formed between the outer frame portion and the protruding portion.

* * * * *